US005215457A

United States Patent [19]

Sebastiani

[11] Patent Number: 5,215,457

[45] Date of Patent: Jun. 1, 1993

[54] COMBUSTION PROCESS AND GAS BURNER WITH LOW NOX, CO EMISSIONS

[75] Inventor: Enrico Sebastiani, Legnano, Italy

[73] Assignee: Worgas Bruciatori S.r.l., Modena, Italy

[21] Appl. No.: 465,085

[22] PCT Filed: Aug. 3, 1987

[86] PCT No.: PCT/IT87/00079

§ 371 Date: Jan. 24, 1990

§ 102(e) Date: Jan. 24, 1990

[87] PCT Pub. No.: WO89/01116

PCT Pub. Date: Feb. 9, 1989

[51] Int. Cl.[5] ..... F23D 14/10

[52] U.S. Cl. ..... 431/7; 431/326

[58] Field of Search ..... 431/7, 8, 326, 328, 431/354; 239/567, 566, 557, 558

[56] References Cited

U.S. PATENT DOCUMENTS

| | | | |
|---|---|---|---|
| 3,829,279 | 8/1974 | Qualley et al. | 431/354 |
| 4,156,591 | 5/1979 | Anderson | 431/354 |
| 4,915,621 | 4/1990 | Schilling et al. | 431/326 X |

FOREIGN PATENT DOCUMENTS

| | | | |
|---|---|---|---|
| 0009831 | 4/1980 | European Pat. Off. . | |
| 0217470 | 4/1987 | European Pat. Off. . | |
| 2132968 | 1/1972 | Fed. Rep. of Germany . | |
| 2305689 | 3/1976 | France | 431/328 |
| 1078951 | 8/1967 | United Kingdom | 431/328 |
| 1264332 | 2/1972 | United Kingdom | 431/328 |
| 197807 | 7/1978 | United Kingdom | 431/354 |
| 1579829 | 11/1980 | United Kingdom | 431/354 |

*Primary Examiner*—Carl D. Price

*Attorney, Agent, or Firm*—Lowe, Price, LeBlanc & Becker

[57] ABSTRACT

The process obtains a plurality of small flames which become violet when combusting natural gas. In particular the amount of primary air induced is at least 80% of the air stoichiometrically required for combustion; the secondary air laps all sides of each singly small flame arising from the small group of slots on the burner body, in the area where each flame leaves the surface of the burner body so as to swell it making its width at least as big as its height and/or alternatively the contact surface between each flame and the secondary air is increased right from the first steps in combustion, so that each small group creates a small flame with two divergent bladed wings, similar to "butterfly wings."

15 Claims, 5 Drawing Sheets

FIG. 6
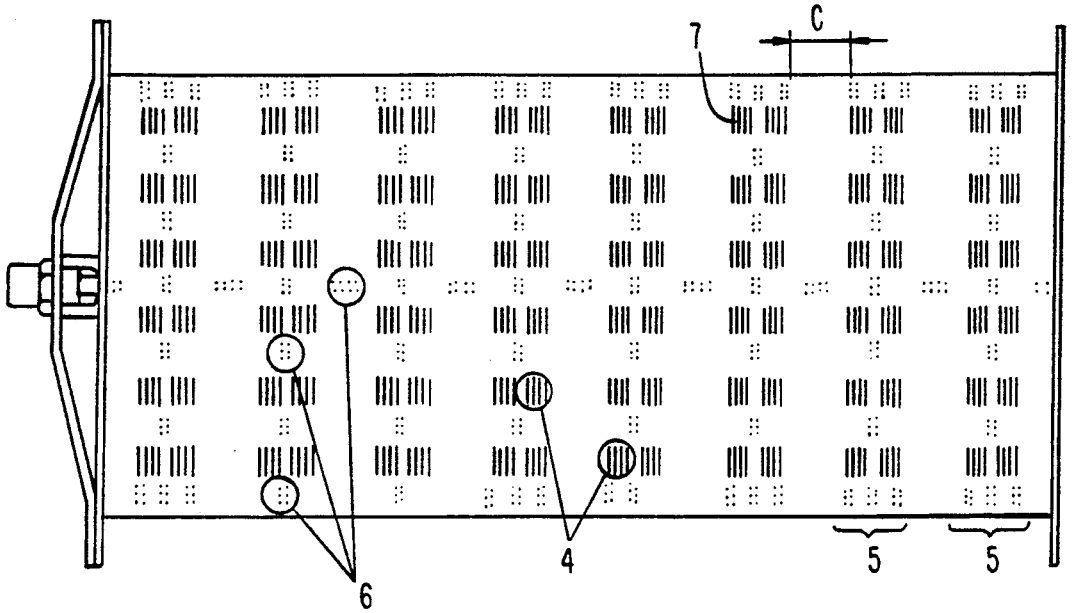
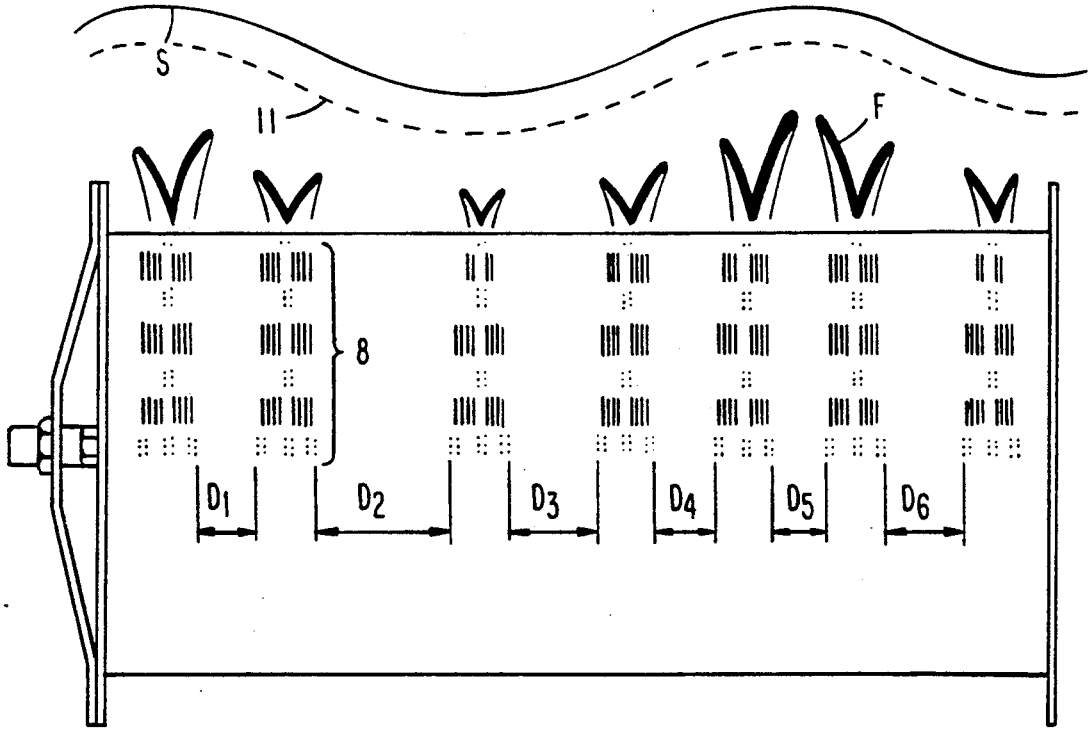
FIG. 7

FIG. 10a
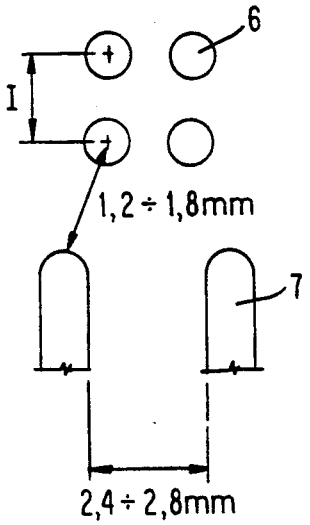
FIG. 10b
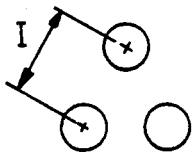
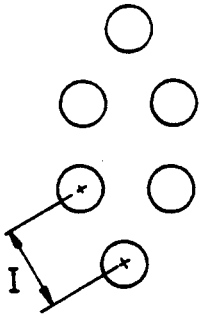
FIG. 10c
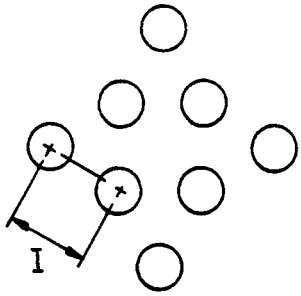
FIG. 10d

COMBUSTION PROCESS AND GAS BURNER WITH LOW NOX, CO EMISSIONS

FIELD OF THE INVENTION

This invention relates to a process and equipment to obtain efficient combustion of gas by means of an atmospheric burner.

BACKGROUND OF THE PRIOR ART

Burners for gaseous fuels are generally divided into fan-assisted burners and atmospheric burners.

In general, in using atmospheric burners an imperfect combustion may occur, with harmful emissions of carbon monoxide and nitric oxides which can cause atmospheric pollution.

EP-A-0009831 refers to an atmospheric burner (POLIDORO) in which the perforated surface of a cylindrical burner diffuser consists of transverse groups comprising subgroups of slots spaced out 2 mm in a transverse direction, with pilot holes at each end. Each sub-group consists of a densely-packed series of parallel transverse slot with center distance of only 1.2 mm, in order to obtain a "single flame front" from each group, i.e., a big vertical flame, with the aim of reducing burner noise and providing high thermal power.

Also known, per EP-A-0217470, is an atmospheric burner (NEFIT) in which the primary air-gas mixture, drawn in through a Venturi tube, is then directed downwards at the outlet of this tube. The flow is then fed back, up at the side with turbulence reduced to a minimum, to feed the slots in a perforated diffuser. The purpose is to obtain combustion which is as uniform as possible, "without any disturbing noise being produced". In fact (see figures) the surfaces of the diffuser of the body present groups of slots similar to EP-A-0009831.

Also, DE-A-2132968 (FOGLIANI, PANINI and VECCHI), teaches covering of an atmospheric burner equipped with small groups of slots arranged close together and/or rows of holes, aligned transversely, with the relative pilot holes at the ends. The burner body has a polygonal cross-section, in particular featuring a diffuser with two angled sides which, as shown in FIG. 2, have slots across the joint between these sides, creating a double-horned flame on a transverse plane of the diffuser itself. The flame in this burner is more stable and noise level is reduced.

However, prior art does not envisage the reduction of harmful emissions of nitrogen oxides and carbon monoxide. This may be justified by the fact it was considered impossible to solve the problem of reducing pollutant emissions from atmospheric burners simply by acting on the combustion method or on the proportioning of the burner itself.

SUMMARY OF THE DISCLOSURE

The object of this invention is to provide a process and an atmospheric burner to obtain gas combustion having very low levels of harmful emissions.

This and related objects are realized by providing a combustion process, in a novel atmospheric burner.

The novel process involves the steps of:

aspiring, by means of a Venturi tube, an amount of primary air equal to at least 80% of the air stoichiometrically required for combustion;

enabling a flow of secondary air to contact the gas-primary air mixture immediately after ignition to bring the total air involved to a level above the stoichiometric value; and starting and completing combustion within the thickness of a blade of a wing-shaped flame providing a luminous emission of violet color within the visible spectrum, at a wavelength below 0.42 micron, from the combustion of natural gases.

BRIEF DESCRIPTION OF THE DRAWING

The present invention is described on the basis of some exemplary embodiments illustrated in the attached drawings, in which:

FIG. 6 shows a plan view of the upper part of a burner;

FIG. 7 shows a plan view of a variant of the burner in FIG. 6;

FIGS. 10*a*, 10*b*, 10*c* and 10*d* show views of possible variants of the sub-groups of holes in which the mutual positions of a sub-group of slots and a sub-group of holes is shown.

DESCRIPTION OF THE PREFERRED EMBODIMENTS

Figure 1:
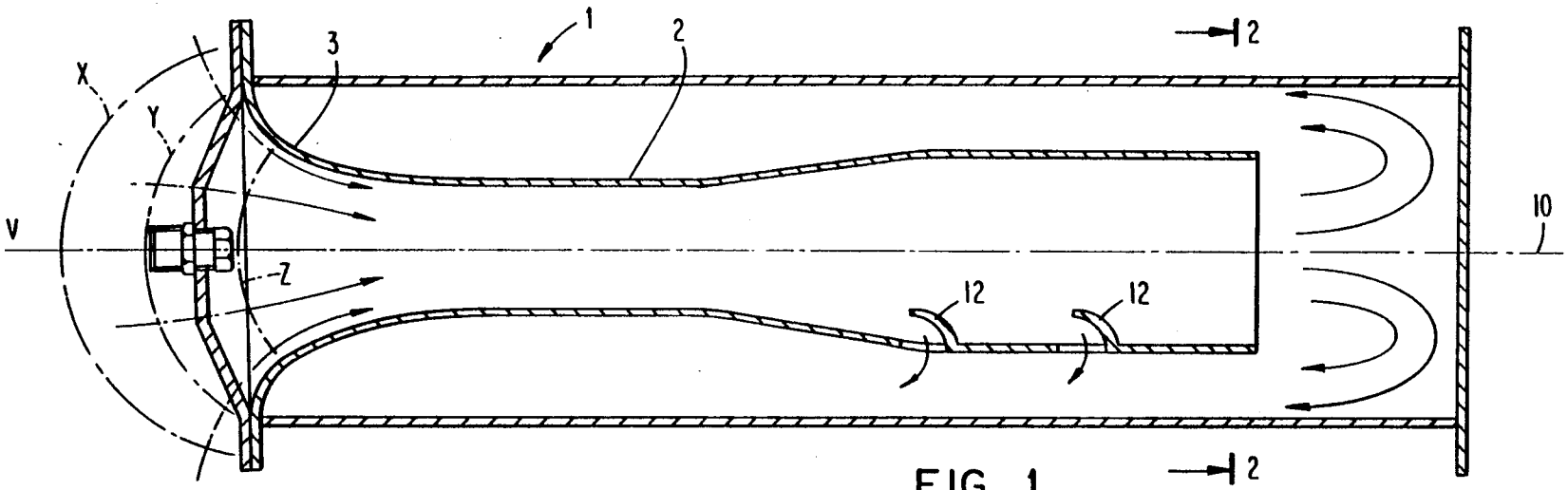
FIG. 1 shows a longitudinal sectional view of a burner.

The bladed flame is a new phenomenon. In reality, the bladed flame is not vertical, nor big or compact, but divergent small and thin.

This new process reduces harmful emissions to extremely low levels, even in combustion chambers whose thermal power, in reference to their base area, is at least 40 W/cm$^2$. Even if it could be known, in general terms, that it was possible to supply the burner with a quantity of primary air exceeding 80% of the stoichiometric air value, given the availability of secondary air to bring the total above the stoichiometric parameter, however the burner bodies produced according to the prior art were not of a type which would function satisfactorily in these conditions because of the overheating of the thin sheet metal of which the burner's diffuser is constructed. Moreover, the prior art did not allow the construction of burners with low harmful gas emissions for combustion chambers with thermal power exceeding 40 W/cm$^2$ of base area. In addition, if a thermal power rating of 1.1 kW/cm$^2$ of burner's diffuser mixture outlet area was exceeded, it would then become impossible to draw in a quantity of primary air exceeding 80% of the stoichiometric value. The values of thermal power (equal to specific combustion capacity) were generally 1.3–1.7 kW/cm$^2$, which allowed the risk of overheating to be eliminated.

The mixture in the prior art devices travelled at high speed inside the burner, leading to high load losses and making it impossible to draw in large quantities of primary air.

The gas burner implementing the present invention with the burner diffuser made of thin sheet metal, e.g. of thickness around 0.5 mm, is equipped with a Venturi tube having a parabolic intake, with all parts proportioned aerodynamically to allow infeed with primary air in a proportion of over 80% of the stoichiometric requirement. Its specifications are: thermal power not exceeding 1.1 kW/cm$^2$ of area of the ports for the outflow of the mixture from the burner diffuser, air-gas mixture average speed not exceeding 4.5 m/s. Preferably, the air-gas mixture average speed is 4 m/s in the neck of the Venturi tube and, between the tube and the diffuser, has an average speed not exceeding 2.5 m/s and is preferably 2 m/s.

The slots in the burner diffuser are arranged in aligned transverse groups, each group being appropriately subdivided longitudinally into two subgroups of slots lying not very close together. Each group thereby generates a double bladed flame which may be characterized as being generally of a butterfly-wing shape, having its center line perpendicular to the longitudinal axis of the burner and its lower vertex on the stretch of burner between the two sub-groups of slots.

This specially shaped flame allows secondary air to come into contact with it on all sides over a wide surface area, providing complete combustion in the bladed flame from the very first moment. By contrast, in conventional flames there are no less than three zones in which combustion gradually occurs: an internal low-temperature area (blue-green in colour) where the air-fuel mixture is heated to the ignition temperature; an intermediate zone (blue in colour) where incomplete combustion of the mixture occurs, leaving residues of carbon monoxide and hydrogen; and a single external zone which is violet in colour, where the gases not burnt in the intermediate zone undergo combustion as they come into contact with the secondary air.

The groups of slots are arranged in rows perpendicular to the burner axis. The distance between each group of slots in any one row is equivalent to at least 65% of the length of the longest slot. The axial distance between two rows of slots is at least nd/2, where d is the axial length of the group and n is the number of groups in a row, or the number of groups in two adjacent rows when the groups are staggered to form a chess-board type lay-out.

The number of slots in any one group must be between 2 and 5. Moreover, the slots may be arranged so that the outline of the flame halo corresponds to the exposed profile of the heat-exchanger. In addition to providing excellent heat-exchange conditions, this reduces CO emissions to a minimum. The stretch between the to sub-groups of slots in each group must be between 2.4 and 2.8 mm, and this ensure the generation of stable bladed flames.

When burning natural gases, the application of this method in a burner according to this invention generates bladed flames of violet colour: measurements made have given wavelength values below 0.42 micron, which is within the violet field of the visible spectrum.

In the case of atmospheric burners having thin sheet-metal diffusers of the type according to this invention, the bladed flame is the only shape providing minimal emissions of $NO_x$ and CO. This, therefore, represents the achievement of the object of this invention.

The bladed flame, when it is violet in colour for combustion of natural gases, is the phenomenon which indicates the effect of a new, highly advantageous combustion method in the burner according to the invention.

The prior art does not provide atmospheric burners with bladed flames; quite the contrary, in order to increase thermal power and flame stability, the known burners incorporate features intended to group the flames together into solid vertical formations as far as possible, to provide the so-called "single front". POLIDORO and FOGLIANI, PANINI and VECCHI fall into this category; NEFIT, while not discussing the question, however shows a similar slot lay-out. This, in fact, reduces the flame-secondary air contact surface considerably.

On the other hand, the burner which implements the method described in the invention is designed to increase the flame-secondary air contact surface to the greatest possible extent. It generates thin individual flames, each with a large surface area beginning from the stretch between the two sub-groups, with a couple of divergent wings which remain completely separate.

The great advantage in relation to the prior art is the achievement of high thermal power without harmful emissions, and without overheating of the burner.

In fact, the burners according to the prior art, provided with groups or sub-groups of slots, with the body designed in such a manner to allow an intake of primary air certainly below 80%, did not generate bladed flames, producing harmful emission.

If the air intake is not coaxial to the Venturi tube, the latter preferably should be slightly bent with respect to the injector axis in order to obtain concentricity with the diverted mixture flow.

In some cases, in order to facilitate the backflow of the mixture coming out from the Venturi tube, louvers on the latter are kept open to obtain a gradual backflow. In particular, these louvers are open on the Venturi tube in zones far from the flame ports of the burner diffuser. Preferably, the upper part of the burner diffuser, where the slots in small groups are located, has a bending radius that is larger than the radius at a lower part.

Preferably, the number of slots in each group of a row decreases towards the burner's vertical symmetry plane. Moreover the slots can be parallel to each other. In particular, small groups are created by slots of different lengths, outward decreasing. For example, the area occupied by a small group can be a rhombus. This is favorable in general, and particularly so with a chess-board configuration.

So that the halo of the bladed flame may follow the shape of the heat exchanger, the rows made up of small groups are longitudinally located at a variable distance. It is also possible to vary the distance among the groups of a single row. Moreover each group can have a different port area.

The flame lift preventing holes are numerous and at a certain mutual separate according to need. In particular, and they may be placed at the apexes of a square and/or equilateral triangle at a distance of 1.3 to 1.5 mm, preferably 1.4 mm.

Figure 2:
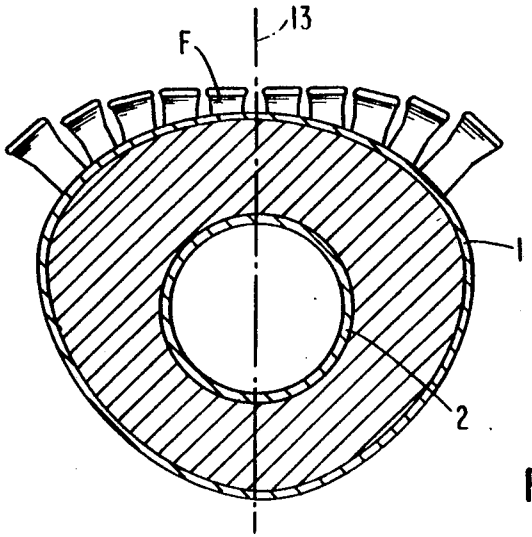
FIG. 2 shows a cross-sectional view along the line A—A in FIG. 1.
Figure 4:
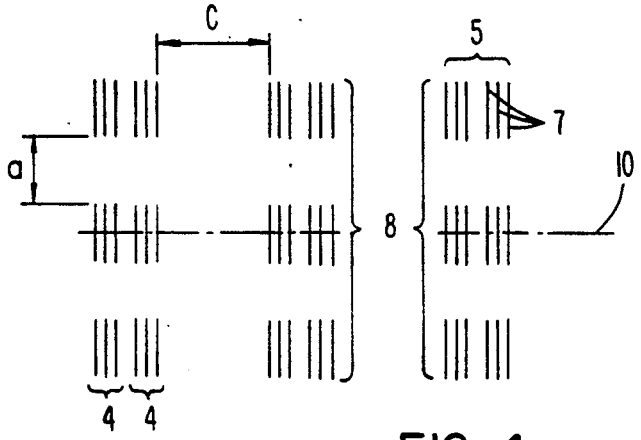
FIG. 4 shows a view of a possible arrangement of the slot groups.
Figure 5:
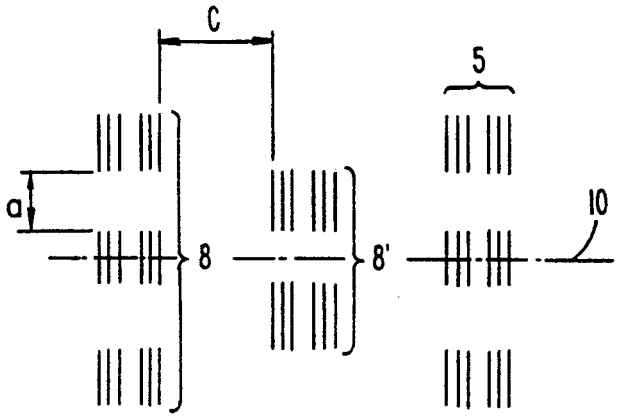
FIG. 5 shows a variant of FIG. 4.
Figure 8:
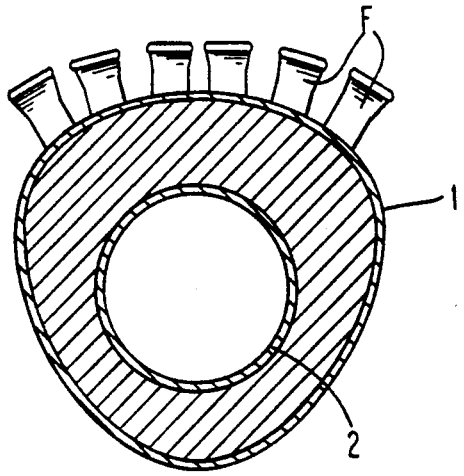
FIGS. 8 and 9 show variants of FIG. 2.
Figure 9:
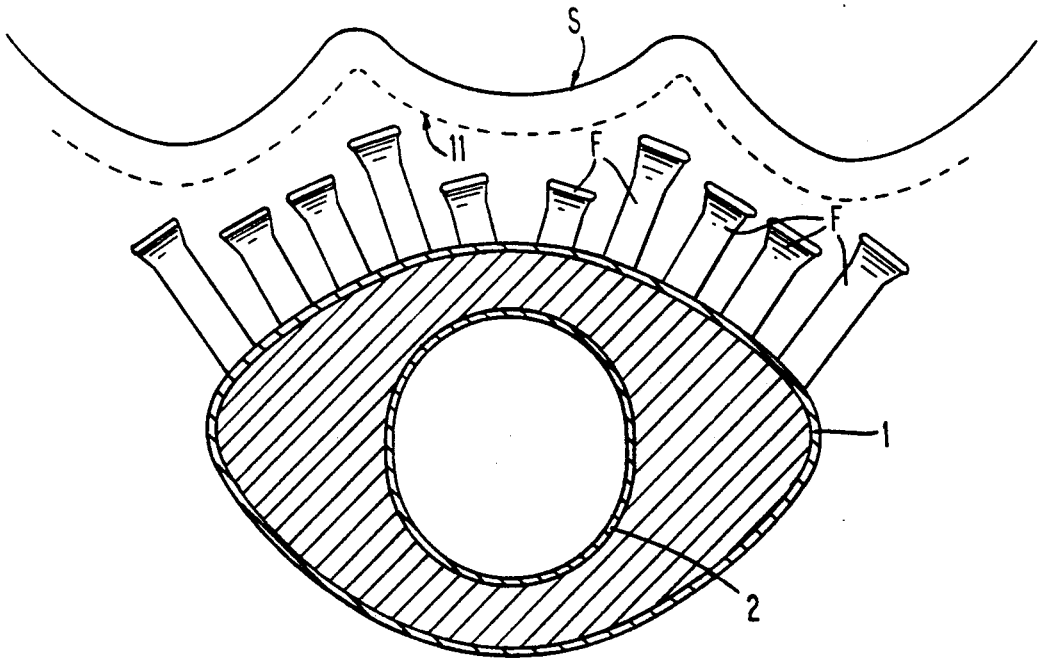

FIGS. 1 and 2 show a burner consisting of a burner body 1 containing inside it a Venturi tube 2, which has a smooth, funnel-shaped mouthpiece 3 with a parabolic form. The Venturi tube 2 leaves a free area (hatched in FIGS. 2, 8 and 9) inside the burner body 1, such as to give an average air/gas mixture speed not exceeding 2 m/sec. The upper part of the burner body has holes out of which comes a series of small flames F. The section of the burner body 1 where the holes are located is convex, with a bending radius greater than the bending radius of the lower part. See FIG. 2. The holes are formed as small groups 5 of slots 7, each consisting of two sub-groups 4 forming a flame F with two wings (FIG. 7). The small groups 5 are arranged in rows 8 perpendicular to the burner axis 10. Flame lift preventing holes 6 are provided between the various small groups 5 (FIGS. 10*a* to 10*d*). The rows of small groups can be arranged alongside one another with the small groups lined up as shown in FIG. 4, the distance "a" between the small groups 5 in this case being at least 0.65b, where "b" is the maximum length of the slots in a group, while the distance "c" between the rows is at least nd/2, where "n" is the number of small groups making up the row and "d" is the width of the totality of slots 7 forming a small group 5. Alternatively the rows 8 of small groups 5 can be offset with respect of rows 8,, as shown in FIG. 5. with this chess-board configuration, the distances "a" and "c" must comply with the conditions described earlier; "n" in this case is the sum of the small groups in the two adjacent, offset rows 8 and 8'. The distance between the sub-groups 4 of each small group 5 is 2.4–2.8 mm.

Figure 3A:
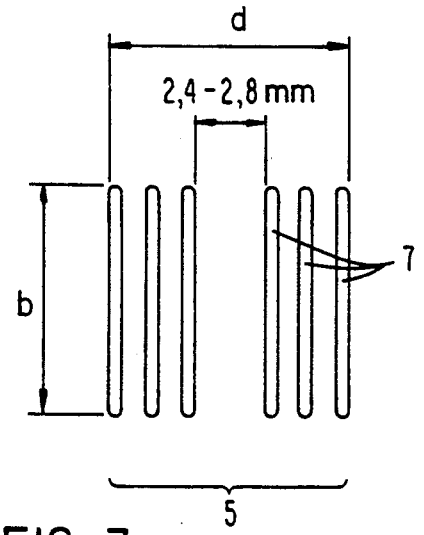
FIG. 3*a* and 3*b* show of possible variations in the slot groups.
Figure 3B:
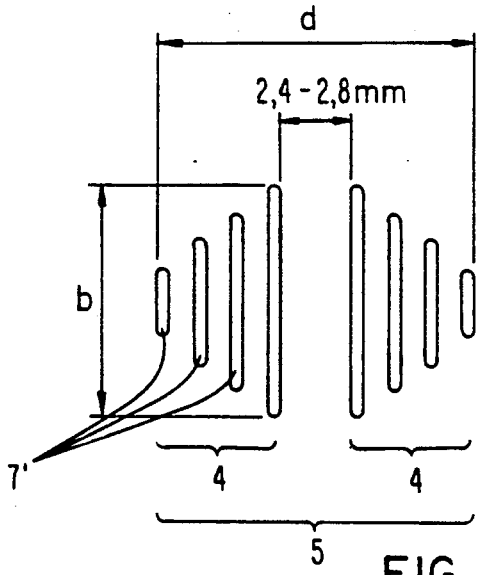

Each sub-group may consist of slots 7, equal in length and parallel (FIGS. 3*a*, 4 and 6); the number of slots can be two, three or four. Alternatively, the sub-group (FIG. 3*b*) may consist of slots 7' of different lengths (decreasing from the center of the group outward) so that the area occupied by each group corresponds to a rhombus. In this case the number of slots making up the sub-group may be two, three, four or a maximum of five.

The flame lift preventing holes 6 can be arranged as illustrated in FIGS. 10*a* to 10*d*, i.e., at the apexes of a square and/or an ideal equilateral triangle, their center distance I being from 1.3 to 1.5 mm., preferably 1.4 mm.

Lastly, in the burner shown in FIG. 7 the rows of small groups 5 are separated at varying distances D1, D2, D3, D4, D5, D6.

This makes it possible to adapt the flame halo 11 to follow the shape of the heat exchanger. A similar adaptation is achieved transversely to the burner by varying the number of slots in each small group (FIG. 9) or spacing out the small groups of a single row.

Louvers 12 are provided far from small groups 5 in order to distribute the backflow along the burner body 1. The particular shape and colour of the flame makes it possible to achieve combustion of a high capacity of gas—40 W per square cm of combustion chamber measured in a plan view—with a very low level of harmful emissions.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. A process to obtain the combustion of a gas while generating products of combustion having a very low content of harmful emissions ($NO_x$, CO), by combustion in an atmospheric burner having a diffuser portion, the process comprising the steps of:

providing a quantity of combustible gas and sucking therewith into the atmospheric burner a quantity of ambient air to form an air-gas mixture which comprises at least 80% of the air stoichiometrically required for the combustion;

burning the air-fuel mixture while providing secondary air, which from the beginning of the combustion laps all sides of each of a plurality of single bladed small flanges (F) exiting from each of a plurality of groups of slots on said diffuser portion of the burner, in such a way that the total amount of air thus involved in the combustion exceeds a stoichiometrical air value; and completing combustion of the gas within the thickness of the flames corresponding to the groups of slots so as to cause the emission of violet light therefrom of a wavelength less than 0.42 micron.

2. The process according to claim 1, wherein:

each group of slots produces a small flame (F) with two divergent bladed wings.

3. The process according to claim 1, wherein:

a distance between the small flames (F) is selected so as to ensure that the halo height on top of the flames follows the shape of the heat exchanger.

4. A burner, for burning a gas so as to generate products of combustion that are low in harmful constituents, comprising:

a suction tube comprising a Venturi tube portion; and a slotted and pierced diffuser having a plurality of small groups of slots and flame lift preventing holes located in rows perpendicular to a longitudinal axis of the burner, a distance between said small groups in each row being at least 0.65b, where "b" is the length of the longest slot of the slots in each small group a distance between adjacent rows being at least nd/2 where "d" is the width in an axial direction of the slots forming each small group and "n" is selected to be one of the number of small groups in a row and the number of small groups in two adjacent rows in an arrangement of rows where the rows are offset, the specific combustion capacity of the burner not exceeding 1.1 KW per each $cm^2$ of port area on the diffuser.

5. A burner according to claim 4, wherein:

the Venturi tube has a parabolic mouthpiece shaped so that the sucked air maintains a uniform acceleration throughout the mouthpiece, the maximum average mixture speed being less than 4.5 m/sec., while the burner is sized to be wide enough to maintain an average speed of the flowing mixture under 2.5 m/s.

6. A burner according to claim 4, wherein:

the rows of small groups are offset, thus forming a chess-board configuration.

7. A burner according to claim 4, wherein:

the small groups of slots are split in two sub-groups, each formed to have not less than two nor more than five slots formed very close to each other, the distance between said subgroups being in the range 2.4–2.8 mm.

8. A burner according to claim 4, wherein:

the small groups of slots each comprise parallel slots having different lengths, the longest slot being at the inside of each group and the shortest slots being at the outside.

9. A burner according to claim 4, wherein:

the distance between adjacent rows varies longitudinally along the burner.

10. A burner according to claim 4, wherein:

the distances between said small groups varies across the diffuser.

11. A burner according to claim 4, wherein:

the total port areas of the small groups decrease toward a vertical plane of symmetry of the burner.

12. A burner, according to claim 4, wherein:

the Venturi tube is slightly bent with respect to the jet axis in order to provide concentricity to the flowing mixture of air/gas.

13. A burner according to claim 4, wherein:

louvers are provided on the Venturi tube to provide a gradual backflow to the air/gas flow.

14. A burner according to claim 4, wherein:

an upper part of the diffuser, where the slots in small groups are located, has a bending radius larger than radius of the lower part of the diffuser.

15. A burner according to claim 4, wherein:

holes are provided at the apexes of one of a square and an equilateral triangle at a center distance (I) between 1.3 and 1.5 mm.

* * * * *